US012054330B2

(12) United States Patent
Pinkstone

(10) Patent No.: US 12,054,330 B2
(45) Date of Patent: Aug. 6, 2024

(54) SHIPPING AND DISPENSING CONSTRUCT

(71) Applicant: Graphic Packaging International, LLC, Atlanta, GA (US)

(72) Inventor: Felicia A. Pinkstone, Aston, PA (US)

(73) Assignee: Graphic Packaging International, LLC, Atlanta, GA (US)

( * ) Notice: Subject to any disclaimer, the term of this patent is extended or adjusted under 35 U.S.C. 154(b) by 339 days.

(21) Appl. No.: 17/354,454

(22) Filed: Jun. 22, 2021

(65) Prior Publication Data

US 2021/0403215 A1 Dec. 30, 2021

Related U.S. Application Data

(60) Provisional application No. 63/043,177, filed on Jun. 24, 2020.

(51) Int. Cl.
*B65D 77/04* (2006.01)
*B65B 5/02* (2006.01)
(Continued)

(52) U.S. Cl.
CPC ..... *B65D 77/0413* (2013.01); *B65B 5/024* (2013.01); *B65B 5/06* (2013.01);
(Continued)

(58) Field of Classification Search
CPC .... B65D 77/0413; B65D 77/28; B65D 77/30; B65D 2577/047; B65D 5/009; B65D 5/46072; B65D 5/5495; B65D 5/542; B65D 2571/00141; B65D 2571/00327; B65D 2571/00037; B65D 2571/00993;
(Continued)

(56) References Cited

U.S. PATENT DOCUMENTS 396,570 A 1/1889 Hotchkiss
637,838 A 11/1899 Vernon
(Continued)

FOREIGN PATENT DOCUMENTS

CA 1079240 6/1980
EP 0 060 504 B1 11/1984
(Continued)

OTHER PUBLICATIONS

International Search Report and Written Opinion for PCT/US2021/038427 dated Oct. 18, 2021.
(Continued)

*Primary Examiner* — Christopher R Demeree
(74) *Attorney, Agent, or Firm* — Womble Bond Dickinson (US) LLP

(57) ABSTRACT

A package that can comprise a shipping and dispensing construct comprising a plurality of panels and dispensing features extending in one or more panels of the plurality of panels. The package further can comprise a plurality of product holding containers that are removably attached to one or more panels of the plurality of panels. The dispenser features can be for forming the package into a plurality of segments, and each segment of the plurality of segments can be for comprising a portion of the shipping and dispensing construct and at least one of the product holding containers of the plurality of product holding containers.

59 Claims, 8 Drawing Sheets

(51) Int. Cl.
*B65B 5/06* (2006.01)
*B65D 77/28* (2006.01)
*B65D 77/30* (2006.01)

(52) U.S. Cl.
CPC ..... *B65D 77/28* (2013.01); *B65D 77/30* (2013.01); *B65D 2577/047* (2013.01)

(58) Field of Classification Search
CPC ..... B65D 71/14; B65B 5/024; B65B 5/06; B65B 2220/16; B65B 13/02; B65B 17/02; B65B 51/02
USPC ..... 229/120.011, 122, 103.2, 120.01; 206/192, 820; 493/128; 53/397, 580
See application file for complete search history.

(56) References Cited

U.S. PATENT DOCUMENTS 1,373,365 A 3/1921 Smouse
1,892,756 A 1/1933 Van Home
2,330,521 A 9/1943 Scheide
2,341,762 A 2/1944 Conklin
2,355,729 A 8/1944 Inman
2,355,730 A 8/1944 Inman
2,359,986 A * 10/1944 Grecco ..... B65D 5/02 229/117.22
2,662,684 A 12/1953 Robins
2,671,584 A 3/1954 Taylor, Jr.
2,684,178 A * 7/1954 Keeler ..... B65D 5/5495 229/117.22
2,723,027 A 11/1955 Reynolds
2,811,250 A 10/1957 Arneson
2,872,036 A 2/1959 Forrer
2,888,132 A 5/1959 Guyer
3,027,063 A 3/1962 Zastrow
3,071,244 A * 1/1963 Doran ..... B65D 5/5495 206/45.29
3,127,991 A 4/1964 Burnett
3,136,410 A 6/1964 Sanford
3,144,190 A * 8/1964 Holt ..... B65D 5/48002 229/120.011
3,158,312 A * 11/1964 Simkins ..... B65D 5/5495 229/120.011
3,186,587 A 6/1965 Englander
3,263,807 A 8/1966 Fingerhut
3,315,875 A 4/1967 Rudolf
3,323,639 A 6/1967 Krzyzanowski
3,324,999 A 6/1967 Farquhar
3,326,369 A 6/1967 Tolaas
3,355,089 A 11/1967 Champlin
3,375,968 A 4/1968 Weiss
3,392,878 A 7/1968 Jackson
3,447,735 A 6/1969 Whitney
D217,441 S 5/1970 Kanaga
3,756,502 A 9/1973 Swanson
3,840,171 A 10/1974 Waters
3,840,172 A 10/1974 Zimmermann
3,872,965 A 3/1975 Taub
3,886,901 A 6/1975 Zeitter
3,949,928 A 4/1976 Perkins
4,068,795 A 1/1978 Forster
4,082,215 A 4/1978 Eichenauer
D250,093 S 10/1978 Schillinger
4,170,325 A 10/1979 Pawlowski
4,192,445 A 3/1980 Card
4,252,236 A 2/1981 Roccaforte
4,277,015 A 7/1981 Crane
D260,076 S 8/1981 Schillinger
4,328,923 A 5/1982 Graser
4,340,169 A 7/1982 Webinger
4,415,082 A 11/1983 Martin
4,449,633 A 5/1984 Johnson et al.
D281,484 S 11/1985 Dickes
4,790,436 A 12/1988 Nakamura
4,794,005 A 12/1988 Swiontek
4,817,866 A 4/1989 Wonnacott
4,860,944 A 8/1989 Wonnacott
4,865,187 A 9/1989 Zulauf
4,895,295 A 1/1990 Montgomery
D306,699 S 3/1990 Michau
4,905,837 A 3/1990 Schuster et al.
4,928,817 A 5/1990 Focke
4,944,405 A 7/1990 Buford
4,961,501 A 10/1990 Hansmann
5,016,813 A 5/1991 Simons
5,020,663 A 6/1991 Dallas
5,044,503 A 9/1991 Wein
5,048,687 A 9/1991 Suzuki
D320,557 S 10/1991 Schuster
5,094,359 A 3/1992 DeMars et al.
5,125,565 A 6/1992 Rogers
5,170,934 A 12/1992 Lemoine
5,292,058 A 3/1994 Zoss et al.
5,294,044 A 3/1994 Clark
5,307,986 A 5/1994 Schuster
5,388,758 A 2/1995 Scovell
5,411,204 A 5/1995 Demay
5,520,284 A 5/1996 Gray
5,522,538 A 6/1996 Gray
5,570,808 A 11/1996 Tassoni
5,590,813 A 1/1997 Abramczyk
5,607,056 A 3/1997 Whiteside
5,675,960 A 10/1997 Weaver
5,871,090 A 2/1999 Doucette et al.
6,041,997 A 3/2000 Jensen
6,126,065 A 10/2000 Wee
6,155,412 A 12/2000 Le Bras
D458,127 S 6/2002 De Groote
D467,499 S 12/2002 Garza et al.
D473,787 S 4/2003 Jones, Jr. et al.
6,554,135 B1 4/2003 Luceri
D478,737 S 8/2003 Sparkowski
D484,043 S 12/2003 Hwang et al.
D484,799 S 1/2004 Hoffman
6,676,010 B1 1/2004 Roseth et al.
D486,390 S 2/2004 Auclair
6,729,475 B2 5/2004 Yuhas et al.
6,808,107 B2 10/2004 Jackson
D505,620 S 5/2005 Huebsch
6,938,818 B2 9/2005 Moorman
6,981,631 B2 1/2006 Fogle et al.
D515,942 S 2/2006 Hamblin
D519,366 S 4/2006 Epstein
7,021,525 B2 4/2006 Jouppi et al.
D519,830 S 5/2006 Yocum
7,097,041 B2 8/2006 Marrale
7,234,593 B2 6/2007 Fath
D561,023 S 2/2008 Jacxsens
7,380,701 B2 6/2008 Fogle et al.
D590,244 S 4/2009 Demalsche
7,552,820 B2 6/2009 Kohler
7,669,755 B2 3/2010 Smalley
7,699,214 B2 4/2010 Mestre et al.
D622,589 S 8/2010 Elias
D630,508 S 1/2011 Hubbard, Jr.
D631,741 S 2/2011 Hubbard, Jr.
D631,742 S 2/2011 Hubbard, Jr.
D631,743 S 2/2011 Hubbard, Jr.
D637,078 S 5/2011 Peng
7,938,257 B2 5/2011 Kohler
8,028,839 B2 10/2011 Learn
D656,394 S 3/2012 Smith
D666,830 S 9/2012 Glenn
D684,858 S 6/2013 Sill
8,701,974 B2 4/2014 Davies
8,740,050 B2 6/2014 Zinck et al.
D717,162 S 11/2014 Baker
D719,018 S 12/2014 Levy
9,033,209 B2 5/2015 Fogle et al.
9,073,658 B2 7/2015 Spivey, Sr. et al.
D741,175 S 10/2015 Amindjanov
9,162,793 B2 10/2015 Stewart
9,169,037 B2 10/2015 Pinkstone

(56) References Cited

U.S. PATENT DOCUMENTS

| | | | | |
|---|---|---|---|---|
| 9,211,971 | B2 | 12/2015 | Fogle et al. | |
| 9,248,933 | B2 | 2/2016 | Spivey, Sr. et al. | |
| D753,994 | S | 4/2016 | Pantelleria | |
| 9,309,023 | B2 | 4/2016 | Hubbard, Jr. | |
| 9,321,553 | B1 | 4/2016 | Spivey, Sr. et al. | |
| D755,624 | S | 5/2016 | Ng | |
| 9,346,234 | B2 | 5/2016 | Hajek et al. | |
| D762,468 | S | 8/2016 | Pantelleria et al. | |
| D769,114 | S | 10/2016 | Montemayor | |
| 9,505,516 | B2 | 11/2016 | Hubbard, Jr. | |
| D775,947 | S | 1/2017 | Epstein | |
| 9,701,438 | B2 | 7/2017 | Fitzwater et al. | |
| D805,894 | S | 12/2017 | Lee | |
| 9,845,182 | B2 | 12/2017 | Baldino | |
| D809,930 | S | 2/2018 | Kagawa | |
| D810,561 | S | 2/2018 | Garnett | |
| D811,875 | S | 3/2018 | Haen et al. | |
| D813,029 | S | 3/2018 | Borkovetz et al. | |
| D814,296 | S | 4/2018 | Collins | |
| 10,017,290 | B2 | 7/2018 | Faulkner et al. | |
| 10,086,972 | B2 | 10/2018 | Hajek | |
| 10,232,973 | B2 | 3/2019 | Burke | |
| 10,239,651 | B2 | 3/2019 | Exner et al. | |
| D848,835 | S | 5/2019 | Exner | |
| D864,751 | S | 10/2019 | Exner | |
| D864,753 | S | 10/2019 | Exner | |
| D866,321 | S | 11/2019 | Bennett | |
| D880,999 | S | 4/2020 | Sill | |
| D887,830 | S | 6/2020 | Kirchen | |
| D901,241 | S | 11/2020 | Cohen | |
| D904,870 | S | 12/2020 | Sill | |
| D912,508 | S | 3/2021 | Kirchen | |
| D918,036 | S | 5/2021 | David | |
| D920,099 | S | 5/2021 | Stabile | |
| D923,473 | S | 6/2021 | Jacobsson | |
| 11,203,460 | B2 * | 12/2021 | Hokanson | B65D 5/5495 |
| D949,010 | S | 4/2022 | Sill | |
| D968,952 | S | 11/2022 | Chambers | |
| D975,540 | S | 1/2023 | Castro | |
| D1,009,621 | S | 1/2024 | Houkom | |
| 2004/0031842 | A1 | 2/2004 | Westerman et al. | |
| 2004/0182916 | A1 | 9/2004 | Roseth | |
| 2004/0226988 | A1 | 11/2004 | Fogle | |
| 2004/0245327 | A1 | 12/2004 | Oliff | |
| 2005/0056554 | A1 | 3/2005 | Fath et al. | |
| 2005/0092649 | A1 | 5/2005 | Ford | |
| 2005/0279815 | A1 | 12/2005 | Fogle et al. | |
| 2006/0255105 | A1 | 11/2006 | Sweet | |
| 2007/0095881 | A1 | 5/2007 | Manaige | |
| 2007/0295796 | A1 | 12/2007 | Sutherland | |
| 2008/0087679 | A1 | 4/2008 | Cook | |
| 2009/0039144 | A1 | 2/2009 | Hooi et al. | |
| 2009/0302098 | A1 * | 12/2009 | Learn | B65D 5/5019 220/735 |
| 2010/0108748 | A1 | 5/2010 | Fleming | |
| 2011/0226847 | A1 | 9/2011 | Nakano | |
| 2012/0273387 | A1 | 11/2012 | Ivosevic | |
| 2012/0298732 | A1 | 11/2012 | Stewart | |
| 2013/0112592 | A1 | 5/2013 | Bowers et al. | |
| 2013/0334096 | A1 | 12/2013 | Fath | |
| 2014/0096488 | A1 | 4/2014 | Gonzalez | |
| 2014/0263600 | A1 | 9/2014 | Valencia | |
| 2015/0083625 | A1 | 3/2015 | Paredes et al. | |
| 2016/0101917 | A1 | 4/2016 | Spivey, Sr. | |
| 2016/0176569 | A1 | 6/2016 | Hanke | |
| 2017/0267397 | A1 | 9/2017 | Cooper | |
| 2017/0297796 | A1 | 10/2017 | Ball | |
| 2019/0291932 | A1 | 9/2019 | Chevalier | |
| 2020/0189818 | A1 | 6/2020 | McCree | |
| 2020/0207055 | A1 | 7/2020 | Wirtz | |
| 2021/0016916 | A1 * | 1/2021 | Ford | B65D 71/36 |
| 2021/0309412 | A1 | 10/2021 | Abjean | |
| 2021/0403198 | A1 | 12/2021 | Hajek | |
| 2021/0403199 | A1 | 12/2021 | Weaver | |
| 2022/0017259 | A1 | 1/2022 | Barbieri | |
| 2023/0013072 | A1 | 1/2023 | Stiess | |
| 2023/0356868 | A1 | 11/2023 | Scapin | |
| 2023/0373675 | A1 | 11/2023 | Telman | |

FOREIGN PATENT DOCUMENTS

| | | | |
|---|---|---|---|
| EP | 0 647 199 | B1 | 5/2000 |
| EP | 1 200 316 | B1 | 6/2004 |
| EP | 2 008 937 | A1 | 12/2008 |
| EP | 2 493 772 | B1 | 6/2014 |
| GB | 2 387 591 | | 10/2003 |
| JP | 3062562 | U | 10/1999 |
| JP | 2004-123101 | | 4/2004 |
| JP | 2009-073536 | | 4/2009 |
| JP | 2011-093601 | A | 5/2011 |
| KR | 20-0171748 | | 3/2000 |
| KR | 20-0450117 | Y1 | 9/2010 |
| WO | WO 89/10308 | | 11/1989 |
| WO | WO 98/47417 | | 10/1998 |
| WO | WO 00/71427 | A1 | 11/2000 |
| WO | WO 00/78619 | A2 | 12/2000 |
| WO | WO 2012/148986 | A1 | 11/2012 |

OTHER PUBLICATIONS

Colpac Vizione Cardboard Food Tray. [online] Published on Apr. 20, 2017. Retrieved Dec. 18, 2018 from URL: http://www.castawayfoodpackaging.co.nz/product/01viztfl-vizione-cardboard-food-tray.

International Search Report and Written Opinion for PCT/US2021/038431 dated Oct. 18, 2021.

International Search Report and Written Opinion for PCT/US2021/038434 dated Oct. 19, 2021.

International Search Report and Written Opinion for PCT/US2021/038435 dated Oct. 21, 2021.

International Search Report and Written Opinion for PCT/US2021/038438 dated Oct. 6, 2021.

U.S. Appl. No. 29/756,578, filed Oct. 29, 2020.

U.S. Appl. No. 29/756,579, filed Oct. 29, 2020.

U.S. Appl. No. 29/756,580, filed Oct. 29, 2020.

U.S. Appl. No. 29/756,581, filed Oct. 29, 2020.

U.S. Appl. No. 29/753,802, filed Oct. 2, 2020.

U.S. Appl. No. 17/354,468, filed Jun. 22, 2021.

U.S. Appl. No. 17/354,475, filed Jun. 22, 2021.

U.S. Appl. No. 17/354,486, filed Jun. 22, 2021.

U.S. Appl. No. 17/354,491, filed Jun. 22, 2021.

* cited by examiner

SHIPPING AND DISPENSING CONSTRUCT

CROSS-REFERENCE TO RELATED APPLICATIONS

This application claims the benefit of U.S. Provisional Patent Application No. 63/043,177, filed on Jun. 24, 2020.

INCORPORATION BY REFERENCE

The disclosures of U.S. Provisional Patent Application No. 63/043,177, which was filed on Jun. 24, 2020, and U.S. Design Patent Application No. 29/753,802, which was filed on Oct. 2, 2020, are hereby incorporated by reference for all purposes as if presented herein in their entirety.

BACKGROUND OF THE DISCLOSURE

The present disclosure generally relates to cartons or carriers for holding, displaying, dispensing, and/or transporting boxes, containers, or other types of articles. More specifically, the present disclosure relates to shipping and dispensing constructs that at least partially wrap around at least a portion of one or more product holding containers.

SUMMARY OF THE DISCLOSURE

In general, one aspect of the disclosure is generally directed to a package that can comprise a shipping and dispensing construct comprising a plurality of panels and dispensing features extending in one or more panels of the plurality of panels. The package further can comprise a plurality of product holding containers that are removably attached to one or more panels of the plurality of panels. The dispenser features can be for forming the package into a plurality of segments, and each segment of the plurality of segments can be for comprising a portion of the shipping and dispensing construct and at least one of the product holding containers of the plurality of product holding containers.

In another aspect, the disclosure is generally directed a shipping and dispensing construct for engaging a plurality of product holding containers. The shipping and dispensing construct can comprise a plurality of panels. The product holding containers can be for being removably attached to one or more panels of the plurality of panels. The shipping and dispensing construct further can comprise dispensing features for forming the shipping and dispensing construct into a plurality of segments. The dispensing features can extend in one or more panels of the plurality of panels. Each segment of the plurality of segments can be for comprising at least one of the product holding containers of the plurality of product holding containers that is removably attached to a portion of at least one of the panels of the plurality of panels.

In another aspect, the disclosure is generally directed to a construct blank for forming a shipping and dispensing construct for engaging a plurality of product holding containers. The construct blank can comprise a plurality of panels. The product holding containers can be for being removably attached to one or more panels of the plurality of panels. The construct blank further can comprise dispensing features for forming the shipping and dispensing construct formed from the construct blank into a plurality of segments. The dispensing features can extend in one or more panels of the plurality of panels. Each segment of the plurality of segments can be for comprising at least one of the product holding containers of the plurality of product holding containers that is removably attached to a portion of at least one of the panels of the plurality of panels.

In another aspect, the disclosure is generally directed to a method that can comprise obtaining a construct blank comprising a plurality of panels and dispensing features extending in one or more panels of the plurality of panels. The method further can comprise removably attaching a plurality of product holding containers to one or more panels of the plurality of panels and forming the construct blank into a shipping and dispensing construct so that the shipping and dispensing construct and the plurality of product holding containers form a package. The dispensing features can be for forming the package into a plurality of segments, and each segment of the plurality of segments can be for comprising a portion of the shipping and dispensing construct and at least one of the product holding containers of the plurality of product holding containers.

Other aspects, features, and details of the present disclosure can be more completely understood by reference to the following detailed description, taken in conjunction with the drawings and from the appended claims.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded ore reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to constructs, carriers, sleeves, cartons, or the like, and packages for holding and displaying articles such as containers, product holding containers, boxes, etc. The articles can be used for packaging food and beverage products and personal care products, for example. The articles can be made from materials suitable in composition for packaging the particular food or beverage item, and the materials include, but are not limited to, paperboard and/or other paper products; plastics such as PET, LDPE, LLDPE, HDPE, PP, PS, PVC, EVOH, and Nylon; glass and the like; aluminum and/or other metals; or any combination thereof.

Constructs according to the present disclosure can accommodate articles of numerous different shapes. For the purpose of illustration and not for the purpose of limiting the scope of the disclosure, the following detailed description describes cuboid boxes (e.g., paperboard boxes) at least partially disposed within the carrier embodiments. In this specification, the terms "lower," "bottom," "upper," "top," "outer," and "inner" indicate orientations determined in relation to fully erected constructs or packages.

As described herein, constructs or carriers may be formed by multiple panels, end flaps, and/or other portions of blanks. Such panels, end flaps, and/or other portions of the blanks can be designated in relative terms to one another, e.g., "first", "second", "third", etc., in sequential or non-sequential reference, without departing from the disclosure.

Figure 1:
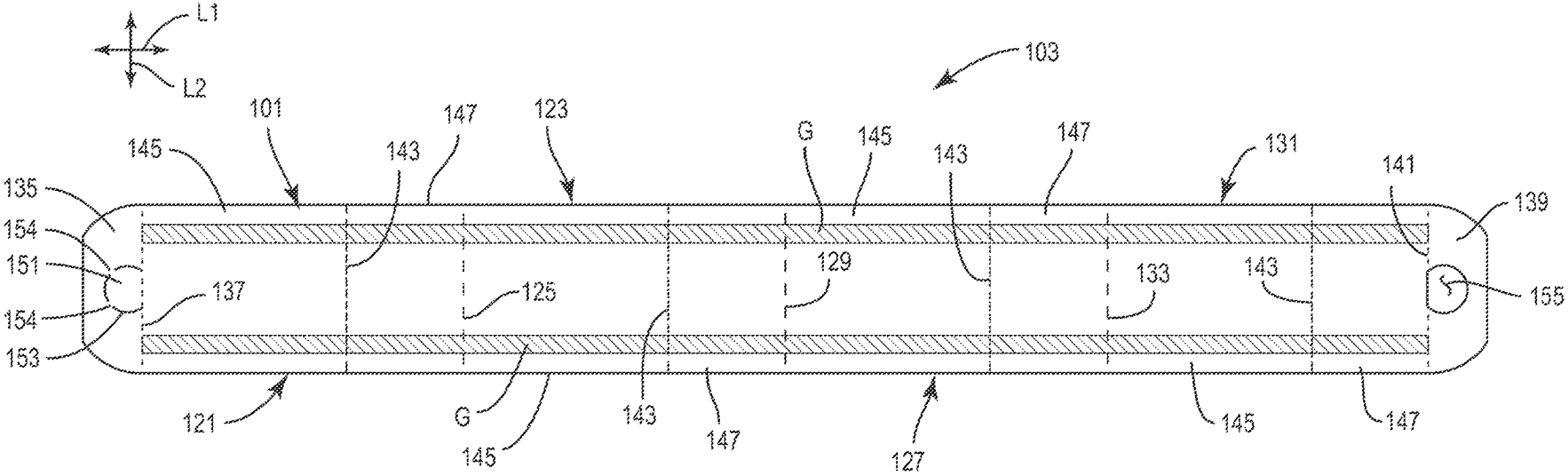
FIG. 1 is an interior plan view of a construct blank used to form a shipping and dispensing construct according to exemplary embodiments of the disclosure.
Figure 4:
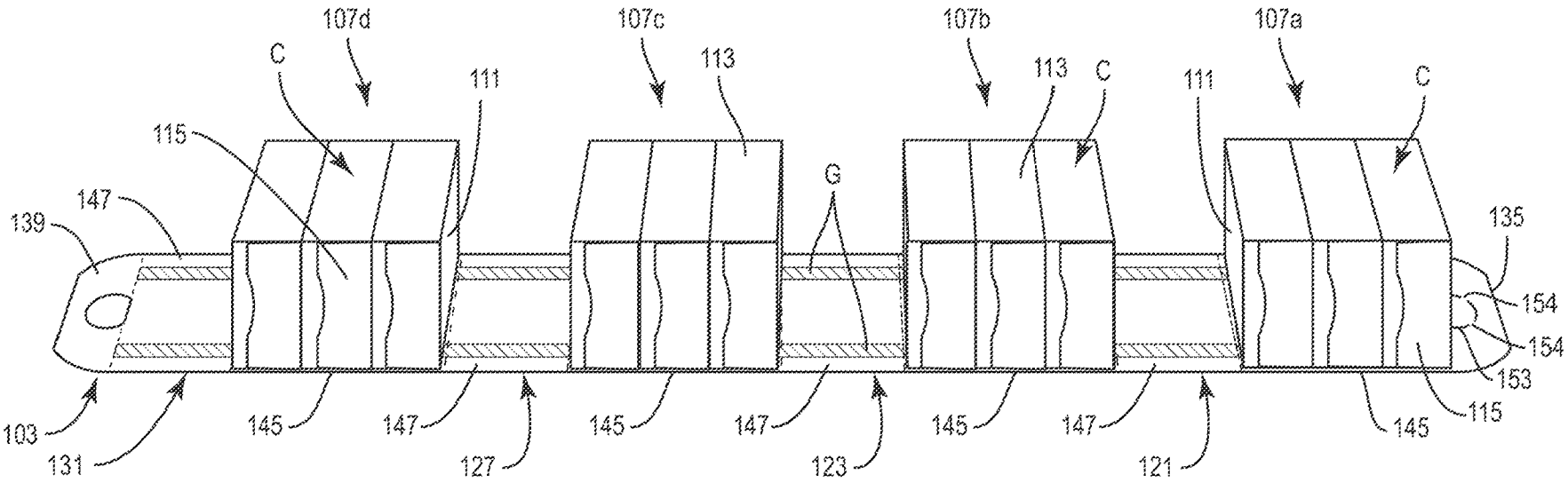
FIG. 4 is a perspective view of the construct blank of FIG. 1 with groupings or sets of product holding containers attached to the construct blank according to exemplary embodiments of the disclosure.
Figure 5:
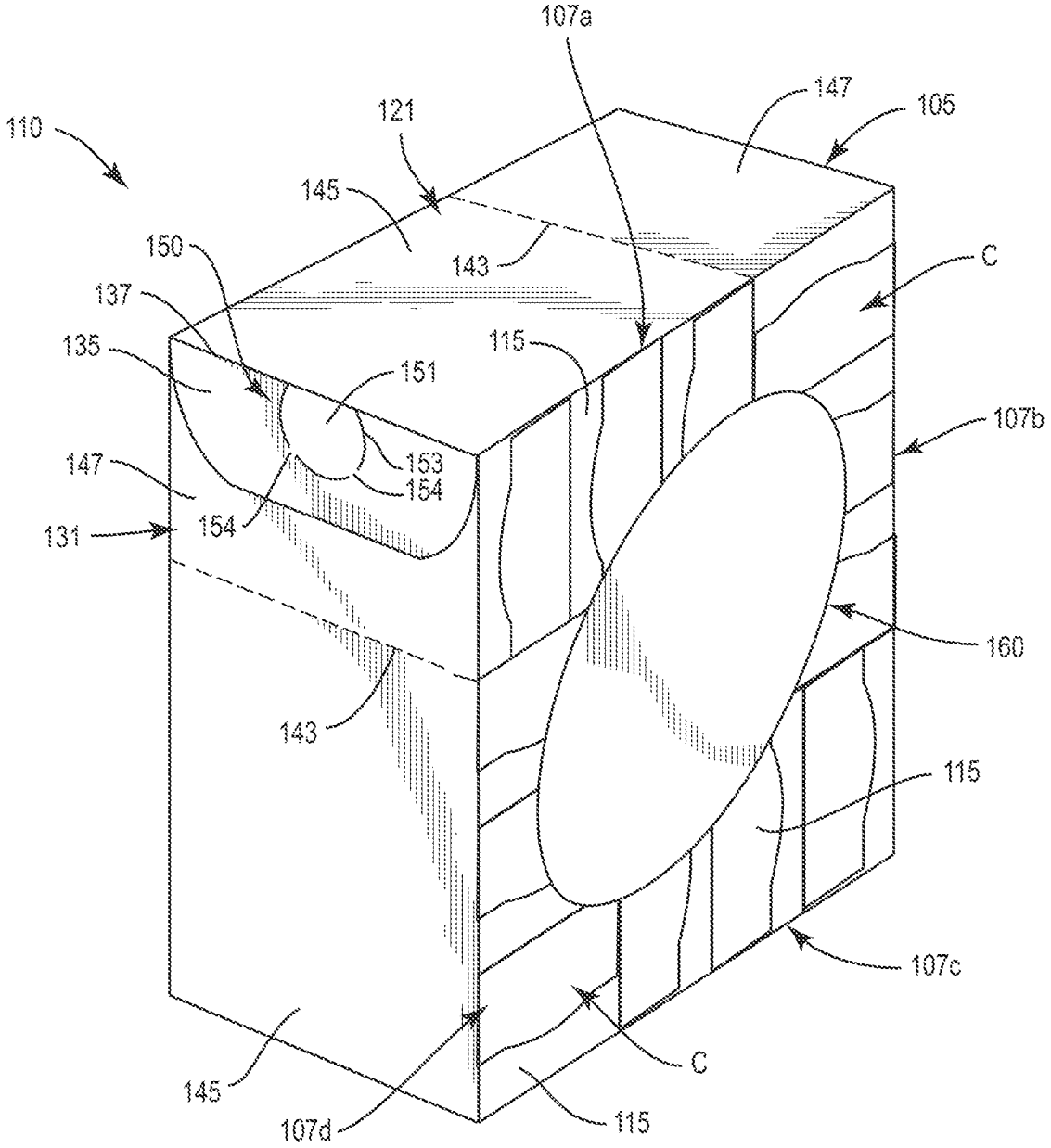
FIGS. 5 and 6 are perspective views of a package including a shipping and dispensing construct formed from the construct blank of FIGS. 1 and 4 and the groupings of product holding containers of FIG. 4 according to exemplary embodiments of the disclosure.
Figure 6:
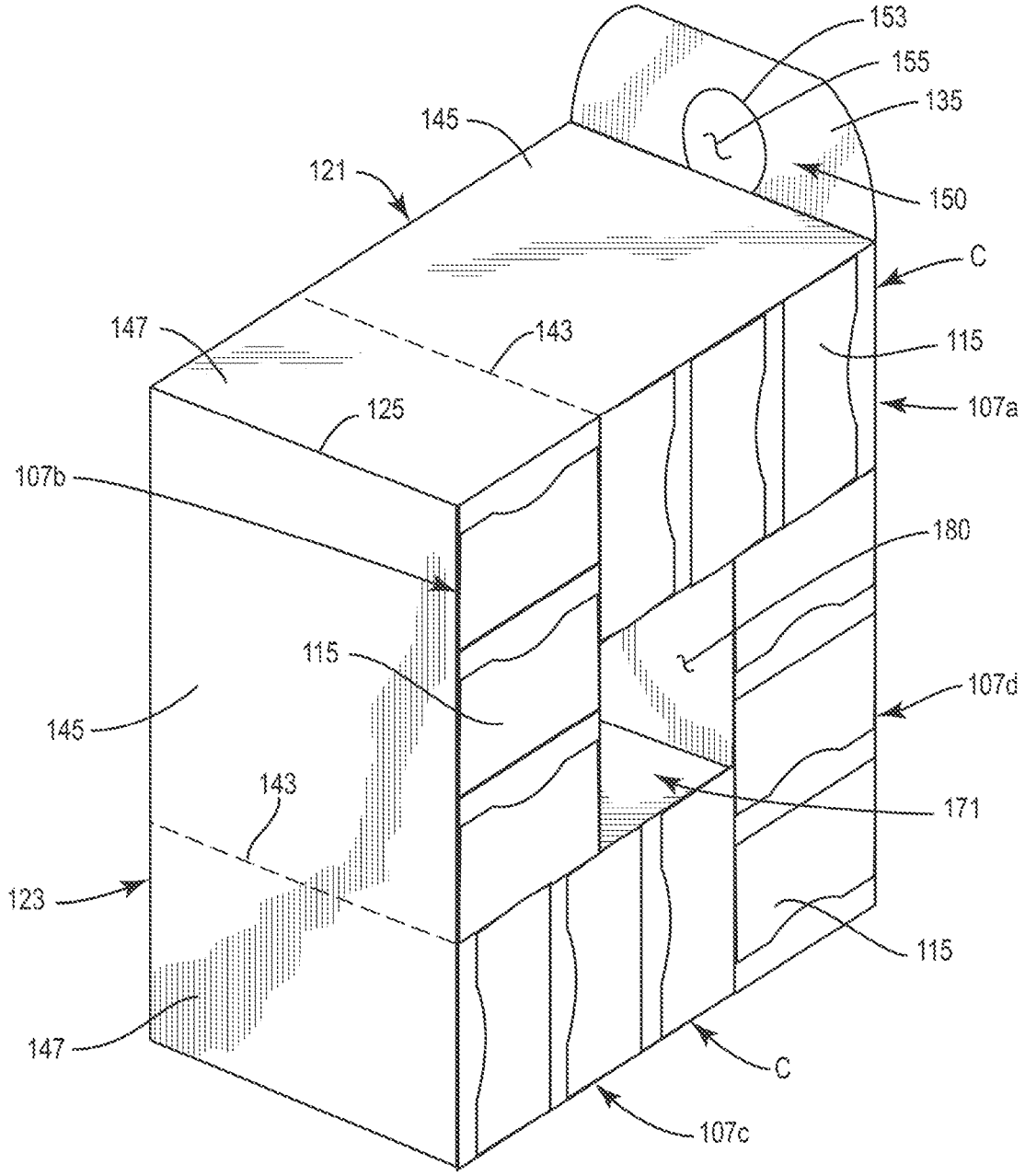

FIG. 1 shows a plan view of an interior side 101 of a construct blank 103 used to form a carrier or shipping and dispensing construct 105 (FIGS. 5 and 6) in accordance with a first exemplary embodiment of the disclosure. As shown in FIGS. 5 and 6 the construct 105 is sized to hold or support twelve containers C in four groupings or sets 107*a*, 107*b*, 107*c*, 107*d* (e.g., each including three containers C or any suitable number of containers C) (FIGS. 4-6). In the illustrated embodiment, the containers C can be product holding containers (e.g., boxes for holding bar soap, boxed snack food items, juice boxes, boxed candy, etc.) formed from paperboard or other suitable material. In one embodiment, each of the containers C has two opposing main container panels 111 (e.g., a top container panel 111 and a bottom container panel 111), two opposing side container panels 113, and two opposing ends 115 (e.g., formed by overlapping end flaps of the containers). The containers C described herein could be any other suitable type and size of container without departing from the disclosure. The construct 105 can be sized and shaped to hold more or fewer than twelve containers C and/or more or fewer than four sets 107*a*, 107*b*, 107*c*, 107*d*. The construct 105 can be provided together with one or more containers C as a package 110 (FIGS. 5 and 6).

As shown in FIG. 1, the construct blank 103 has a longitudinal axis L1 and a lateral axis L2. In the illustrated embodiment, the construct blank 103 includes a first end panel 121, a first central panel 123 foldably connected to the first end panel 121 along a first fold line 125 (e.g., lateral fold line), a second central panel 127 foldably connected to the first central panel 123 along a second fold line 129 (e.g., lateral fold line), and a second end panel 131 foldably connected to the second central panel 127 along a third fold line 133 (e.g., lateral fold line). In one embodiment, the end panels 121, 131 and the central panels 123, 127 could be more broadly referred to as panels (e.g., a first panel, a second panel, a third panel, and a fourth panel). As shown in FIG. 1, the blank 103 also includes a first end flap or attachment flap 135 foldably connected to the first end panel 121 along a fourth fold line 137 (e.g., lateral fold line) and a second end flap or attachment flap 139 foldably connected to the second end panel 131 along a fifth fold line 141 (e.g., lateral fold line). Any of the panels 121, 123, 127, 131 and/or the attachment flaps 135, 139 could be omitted, could be otherwise shaped, arranged, configured, and/or positioned, or could have other features without departing from the disclosure.

In the illustrated embodiment, the construct blank 103 can include dispensing features that can help break down the construct 105 to separate the respective sets 107*a*, 107*b*, 107*c*, 107*d* from the package 110. As shown in FIG. 1, the dispensing features include a tear line 143 (e.g., lateral tear line) extending in each of the panels 121, 123, 127, 131. For example, the tear lines 143 can extend laterally at least partially across each of the panels 121, 123, 127, 131. In one embodiment, the tear lines 143 can at least partially define a first section 145 and a second section 147 in each of the panels 121, 123, 127, 131. For example, the first section 145 of each panel can be sized to engage respective side panels 113 of each of the containers C in a respective set 107*a*, 107*b*, 107*c*, 107*d* (e.g., for a set having three containers C, the first section 145 can have a length in the longitudinal direction L1 of approximately three times the width of the side panels 113 of the containers C), and the second section 147 of each panel can be sized for engaging a main panel 111 of one of the containers C in the respective set (e.g., the second section 147 can have a length in the longitudinal direction L1 approximately equal to the width of the main panels 111 of the containers C). In one exemplary embodiment, the fold lines 125, 129, 133, 137, 141 can be tear lines or can be otherwise weakened in order to facilitate additional tearing of the construct 105 for dispensing the containers C. Any of the dispensing features could be omitted, could be otherwise shaped, arranged, configured, and/or positioned, or could have other features without departing from the disclosure. For example, the tear lines 143 could be omitted.

As shown in FIG. 1, the construct blank 103 can include handle features for forming a handle 150 in the construct 105 (FIGS. 5-7A). In the illustrated embodiment, the handle features include a handle flap 151 foldably connected to the first end panel 121 along the fourth fold line 137. In one embodiment, the handle flap 151 can extend in the first attachment flap 135 and can be separable from the first attachment flap 135 along a cut or tear line 153 or other line of weakening. For example, as shown in FIGS. 1, 4, and 5, the line 153 could be a cut line interrupted by one or more nicks 154 or any other suitable line or weakening or other feature. As shown in FIG. 1, the handle features also can include a handle opening 155 extending in the second attachment flap 139. In one embodiment, the handle opening 155 can be at least partially defined by an edge of the blank 103 extending along at least a portion of the second attachment flap 139 and the second end panel 131 (e.g., the edge of the handle opening 155 can interrupt the fifth fold line 141). Any of the handle features could be omitted, could be otherwise shaped, arranged, configured, and/or positioned, or could have other features without departing from the disclosure. For example, the handle flap 151 could be omitted and/or a handle flap could extend in the second attachment flap 139.

Figure 2:
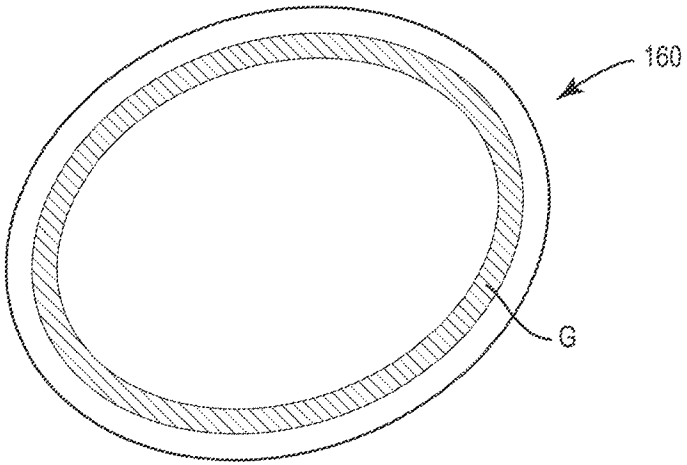
FIG. 2 is an interior plan view of a supplementary panel according to exemplary embodiments of the disclosure.

As shown in FIG. 2, the construct blank 103 can be used in combination with a supplementary panel 160 that optionally can be included in the package 110 (FIG. 5) (e.g., can be secured to ends 115 of the containers C). In the illustrated embodiment, the supplementary panel 160 can be an oval or can be any suitable shape. In an exemplary embodiment, the supplementary panel 160 can include printed graphics and/or information (e.g., promotional materials, coupons, instructions, ingredients, etc.). The supplementary panel 160 could be omitted, could be otherwise shaped, arranged, configured, and/or positioned, or could have other features without departing from the disclosure.

Figure 3:
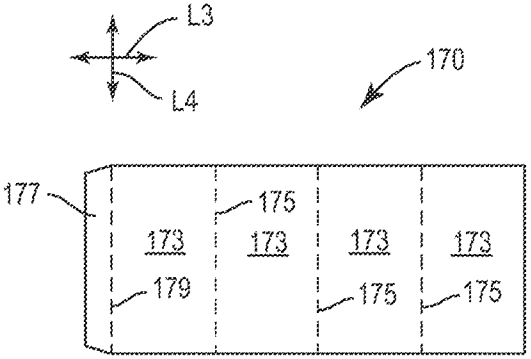
FIG. 3 is an interior plan view of an insert blank used to form an inner sleeve or insert according to exemplary embodiments of the disclosure.

As shown in FIG. 3, the construct blank 103 can be an outer blank and it can be used in combination with an insert blank 170 for forming an inner sleeve or insert 171 that optionally can be included in the package 110 (FIG. 6) (e.g., can be secured to interior-facing side panels 113 of the containers C). In the illustrated embodiment, the insert blank 170 has a longitudinal axis L3 and a lateral axis L4. As shown in FIG. 3, the insert blank 170 can include four side insert panels 173 foldably connected in series along respective lateral fold lines 175 and an attachment flap 177 foldably connected to one of the side panels 173 along a lateral fold line 179. In one exemplary embodiment, the fold lines 175 can be tear lines or could be otherwise weakened in order to facilitate additional tearing of the insert 171 for dispensing the containers C. In an exemplary embodiment, the insert 171 formed from the insert blank 170 can hold additional items (e.g., promotional items, giveaway or bonus items, etc.) in the package 110. The insert blank 170 and the insert 171 could be omitted, could be otherwise shaped, arranged, configured, and/or positioned, or could have other features without departing from the disclosure.

Referring additionally to FIGS. 4-6, formation of the construct 105 from the blank 103 and the formation of the package 110 from the blank 103 and the containers C according to one embodiment of the disclosure will be described. As shown in FIG. 4, the blank can be oriented with the exterior surface facing downwardly and the interior surface 101 facing upwardly. In the illustrated embodiment, attachment features can include glue G (e.g., a releasable glue, such as fugitive glue, or any other suitable adhesive) can be applied to the blank 103 in longitudinal strips (e.g., two strips) as indicated schematically in FIGS. 1 and 4. The glue G could be omitted or could be otherwise shaped, arranged, configured, and/or positioned without departing from the disclosure. For example, any suitable number of glue strips could be included and/or the glue could be applied in any other suitable shape, such as beads or dots of glue. In another example, glue can be applied to the containers C in addition or instead of to the construct blank 103.

As shown in FIG. 4, the containers C can be arranged in the sets 107*a*, 107*b*, 107*c*, 107*d* of three containers C, each. Alternatively, the sets can have any suitable number of containers C. In the illustrated embodiment, each of the sets 107*a*, 107*b*, 107*c*, 107*d* can be aligned with a respective first section 145 of a respective panel 121, 123, 127, 131 and pressed against the respective first section 145 to adhere the side panels 113 of the containers C thereto. Subsequently, the blank 103 can be folded along the fold lines 125, 129, 133 to position the panels 121, 123, 127, 131 and the sets 107*a*, 107*b*, 107*c*, 107*d* in a rectangular shape as shown in FIGS. 5 and 6. In the illustrated embodiment, one of the main panels 111 of one of the containers C in each set 107*a*, 107*b*, 107*c*, 107*d* engages the side panels 113 of containers C in the respective sets 107*b*, 107*c*, 107*d*, 107*a* when the panels and the sets are arranged as shown in FIGS. 5 and 6. In addition, one of the main panels 111 of the container C at the opposite end of each set 107*a*, 107*b*, 107*c*, 107*d* is pressed against the second section 147 of the respective panels 131, 121, 123, 127 to adhere the respective main panel 111 to the respective second section 147 with the releasable glue strips G. Accordingly, for each of the panels 121, 123, 127, 131, the first section 145 is attached to the side panels 113 of the containers C in one of the sets and the second section 147 is attached to the main panel 111 of one of the containers C in another one of the sets. In one embodiment, the releasable glue releasably or removably secures the containers C to the construct 105 so that the containers C can be pulled off of the panels 121, 123, 127, 131 with a predetermined amount of force (e.g., without damaging the containers C).

In the illustrated embodiment, the attachment flaps 135, 139 can be secured to one another in face-to-face contact with glue (not shown), which can be a stronger or more permanent glue than the releasable glue G, for example, or could be any suitable adhesive. Accordingly, the secured attachment flaps 135, 139 can help retain the construct 105 and the containers C in the shape of the package 110 with the panels 121, 123, 127, 131 extending around an interior of the construct 105 along the containers C. In one embodiment, with the attachment flaps 135, 139 secured together, the handle flap 151 can be at least partially aligned with the handle opening 155 to form the handle 150 (FIG. 5). Accordingly, the handle flap 151 can be folded away from the attachment flaps 135, 139 along the fold line 137 to form a handle opening in the attachment flap 135 that is at least partially aligned with the handle opening 155 in the attachment flap 139. In one embodiment, a user can insert one or more fingers through the handle openings in attachment flaps 135, 139 to hold and/or lift the package 110 (FIG. 5).

As shown in FIG. 5, the attachment flaps 135, 139 can be folded along the fold lines 137, 141 against one of the second end panel 131, and the handle flap 151 can be glued to the second end panel 131 to hold the attachment flaps 135, 139 down (e.g., at the nicks 154). Alternatively, the attachment flaps 135, 139 could be folded against the first end panel 121 and the handle flap 151 can be glued to the first end panel 121. This configuration of the package can be more compact than if the attachment flaps 135, 139 are not secured against the panels, and the compact configuration can be beneficial for storage and/or transportation of the package 110. As shown in FIG. 6, the handle 150 can be activated by pulling the attachment flaps 135, 127 away from the second end panel 131, separating the handle panel 151 from the first attachment flap 135 at the nicks 154 (e.g., the handle flap 151 remains glued to the second end panel 131). A user can then insert one or more fingers through the handle opening 155 in the attachment flaps 135, 139 to carry the package 110.

As shown in FIG. 6, the containers C can extend around and at least partially define a central opening 180 in the package 110. In one embodiment, the central opening 180 can be used as an additional handle (e.g., by grasping some of the containers C via the central opening 180) and/or can be used to include additional items (e.g., promotional items, giveaway or bonus items, etc.) in the package 110. For example, the additional items can be attached (e.g., with releasable glue) to the containers C defining the central opening 180. As shown in FIG. 5, the supplementary panel 160 can be attached to the ends 115 of the containers C in the package 110 (e.g., with releasable glue G as shown in FIG. 2). Accordingly, the supplementary panel 160 can at least partially cover the central opening 180. In one embodiment, additional items included in the central opening 180 can be secured to the supplementary panel 160 (e.g., with releasable glue). In some embodiments, a second supplementary panel 160 can be secured to the opposing side of the package with releasable glue, for example.

In the illustrated embodiment, the insert 171 can be formed from the insert blank 170 by folding the insert blank 170 along the fold lines 175, 179, adhering the attachment flap 177 in face-to-face contact with the side panel 173 at the opposite end of the insert blank 170, and positioning the side panels 173 around an interior of the insert 171. The insert 171 can be attached (e.g., with releasable glue) to the containers C extending along the central opening 180 as shown in FIG. 6. Alternatively, the insert 171 can be inserted into the central opening 180 without glue (e.g., the insert 171 can fit snugly in the central opening 180). In the illustrated embodiment, the insert 171 can be fully inserted into the central opening 180 or a portion of the insert 171 can protrude from the central opening 180 on at least one side of the package 110. In one embodiment, the optional insert 171 can be used in combination with the optional supplementary panel 160. In an exemplary embodiment, the insert 171 can help retain one or more additional items (e.g., promotional items, giveaway or bonus items, etc.) in the central opening 180 (e.g., the additional items can be attached to the insert 171 by releasable glue). The insert 171 can be erected from the insert blank 170 before, during, or after the formation of the package 110 and/or the insert 171 or the insert blank 170 can be attached to one or more of the containers C before, during, or after the formation of the package 110.

The package 110, the construct 105, and/or the insert 171 could be otherwise formed without departing from the disclosure.

Figure 7B:
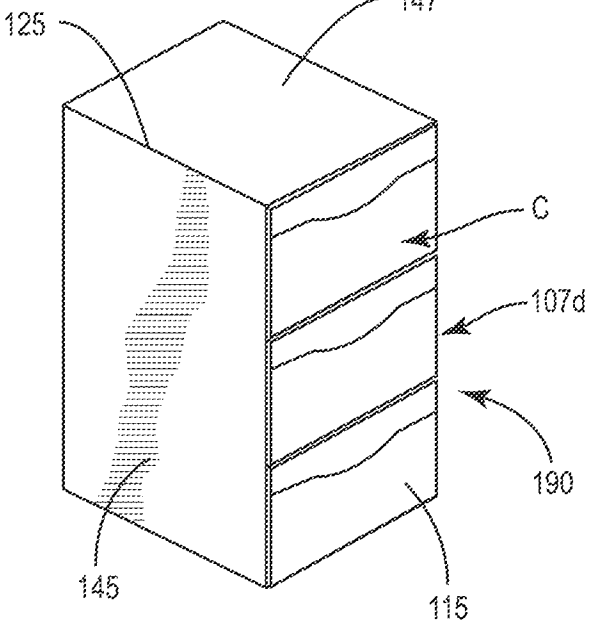
FIGS. 7A and 7B are perspective views of segments formed from the package of FIGS. 5 and 6 according to exemplary embodiments of the disclosure.
Figure 7A:
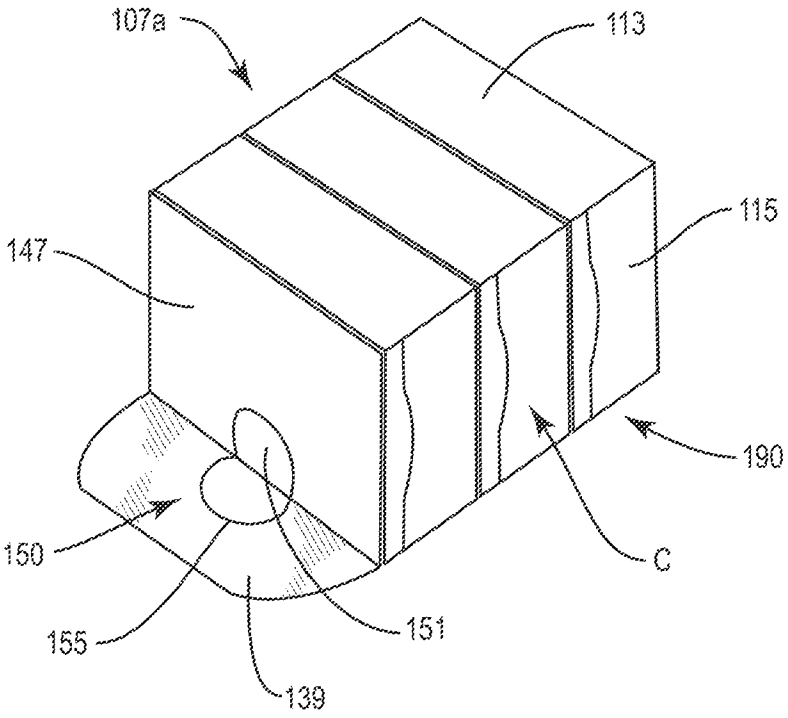

As shown in FIGS. 7A and 7B, the package 110 can be broken down into units or segments 190 by actuating the dispensing features for easier access to the containers C and/or for easier storage of the containers C prior to use, for example. Each of the segments 190 can be formed by tearing the construct 105 along the tear lines 143 to separate the first section 145 from the second section 147 in each panel 121, 123, 127, 131. Accordingly, each of the segments 190 can include a respective set 107*a*, 107*b*, 107*c*, 107*d* attached to the first section 145 of one panel and the second section 147 of a different panel. For example, as shown in FIG. 7A, the segment 190 including the set 107*a* includes the first section 145 of the first end panel 121 and the second section 147 of the second end panel 131 (wherein these sections 145, 147 are connected at the attachment flaps 135, 139). In another example, as shown in FIG. 7B, the segment 190 including the set 107*b* includes the first section 145 of the first central panel 123 and the second section 147 of the first end panel 121 (wherein these sections 145, 147 are connected at the fold line 125). In an exemplary embodiment, the construct 105 can be further broken down by tearing along one or more of the fold lines 125, 129, 133, 137, 141. The containers C can be removed from the segments 190 (e.g., from one or both of the sections 145, 147) by pulling the containers C against the releasable glue G. In some embodiments, the contents of one or more of the containers C could be removed by opening the containers C while the containers are attached to the sections 145, 147. While only the segments 190 including the sets 107*a*, 107*d* are shown in FIGS. 7A and 7B, the segments 190 including the sets 107*b*, 107*c* can be similar or identical to the segment 190 including the set 107*d* in FIG. 7B. The containers C could be otherwise dispensed from the package 110 without departing from the disclosure.

Figure 8:
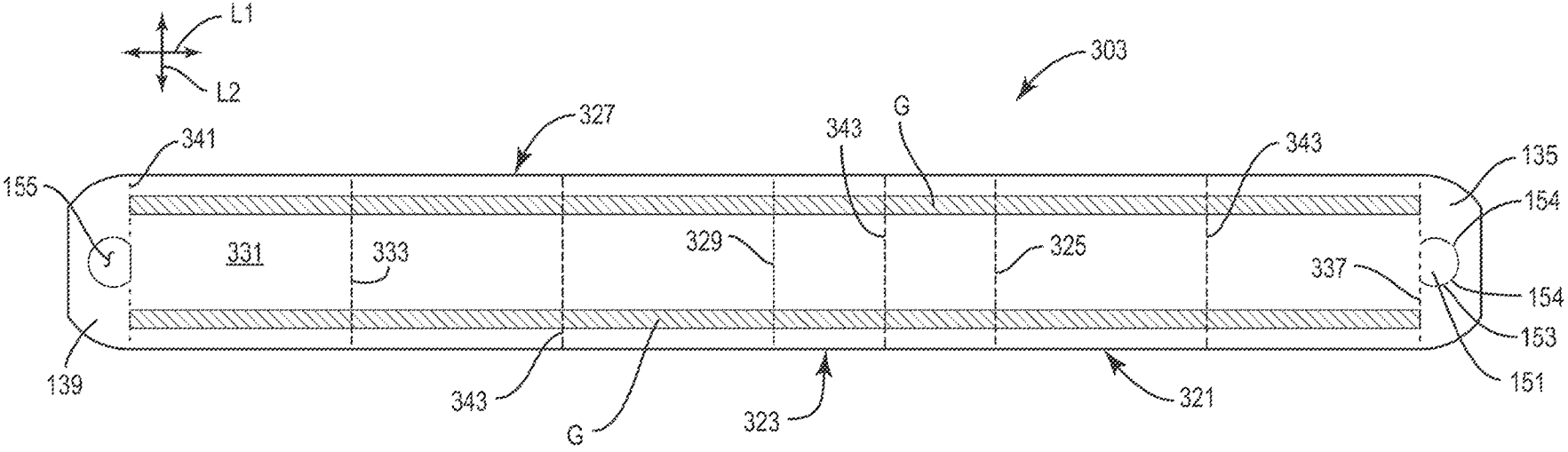
FIG. 8 is an interior plan view of a construct blank used to form a shipping and dispensing construct according to exemplary embodiments of the disclosure.

FIG. 8 shows a blank 303 for forming a shipping and dispensing construct 305 and a package 310 (FIGS. 9 and 10) according to another embodiment of the disclosure. This embodiment is generally similar to the prior embodiments, except for variations noted and variations that will be apparent to one of ordinary skill in the art. Accordingly, similar or identical features of the embodiments have been given like or similar reference numbers. In the illustrated embodiment, the blank 303 is similar to the blank 103 of the prior embodiment with a modified panel arrangement. As shown in FIG. 8, the blank 303 can include a first side panel 321, a bottom panel 323 foldably connected to the first side panel 321 along a fold line 325, a second side panel 327 foldably connected to the bottom panel 323 along a fold line 329, and top panel 331 foldably connected to the second side panel 329 along a fold line 333. In the illustrated embodiment, the first attachment flap 135 can be foldably connected to the first side panel 321 along a fold line 337 and the second attachment flap 139 can be foldably connected to the top panel 331 along a fold line 341. As shown in FIG. 8, the blank 303 can include tear lines 343 (e.g., lateral tear lines) that can be similar to the tear lines 143 of the prior embodiment. In the illustrated embodiment, the tear lines 343 extend in (e.g., bisect) the respective panels 321, 323, 327 into sections similar to the sections 145, 147 of the prior embodiment. In one exemplary embodiment, the fold lines 325, 329, 333, 337, 341 can be tear lines or can be otherwise weakened in order to facilitate additional tearing of the construct 305 for dispensing the containers C. The blank 303 could be otherwise shaped, arranged, configured, and/or positioned, or could have other features without departing from the disclosure. For example, the tear lines 343 could be omitted.

Figure 9:
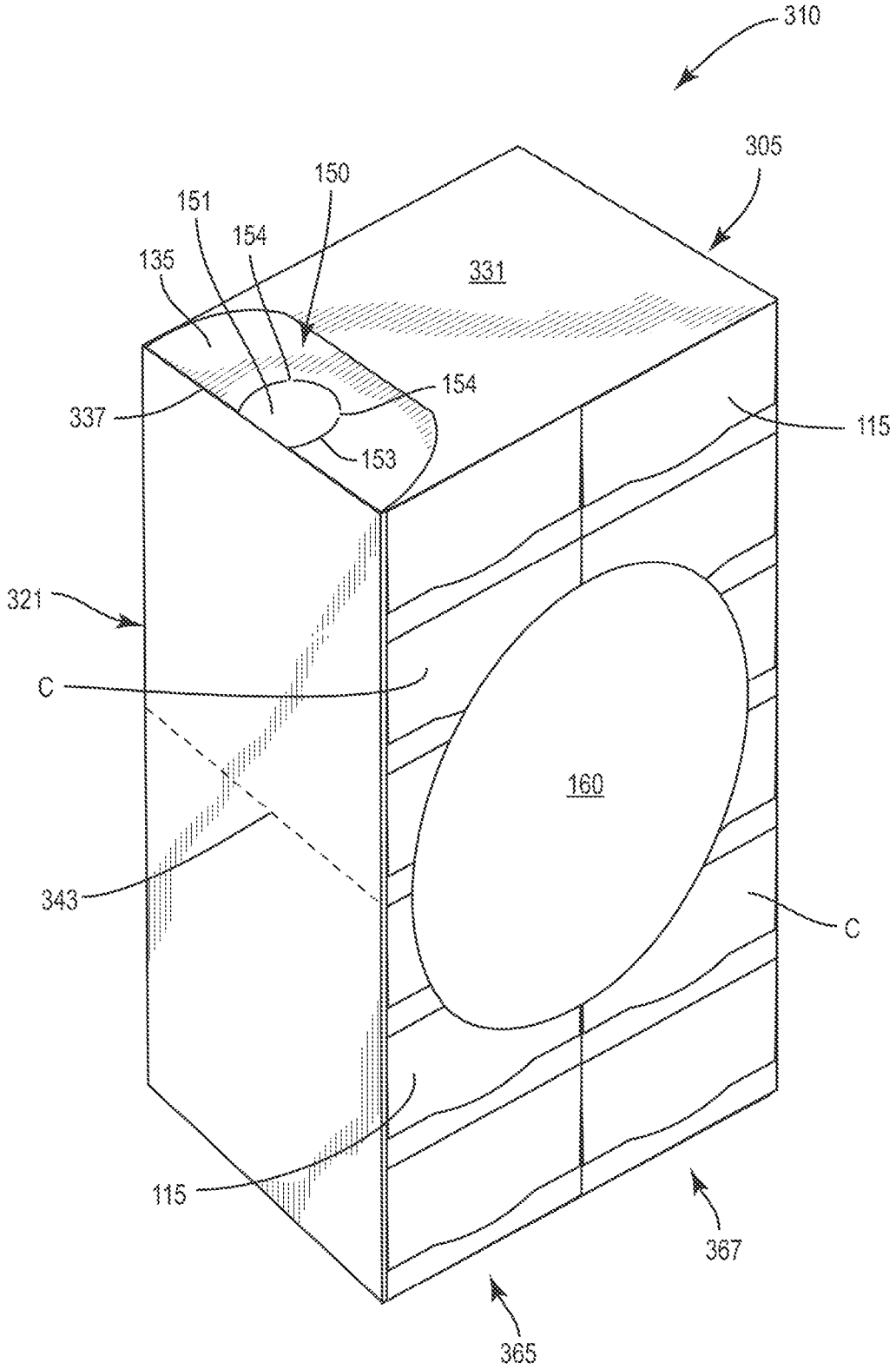
FIGS. 9 and 10 are perspective views of a package including a shipping and dispensing construct formed from the construct blank of FIG. 8 and the product holding containers according to exemplary embodiments of the disclosure.
Figure 10:
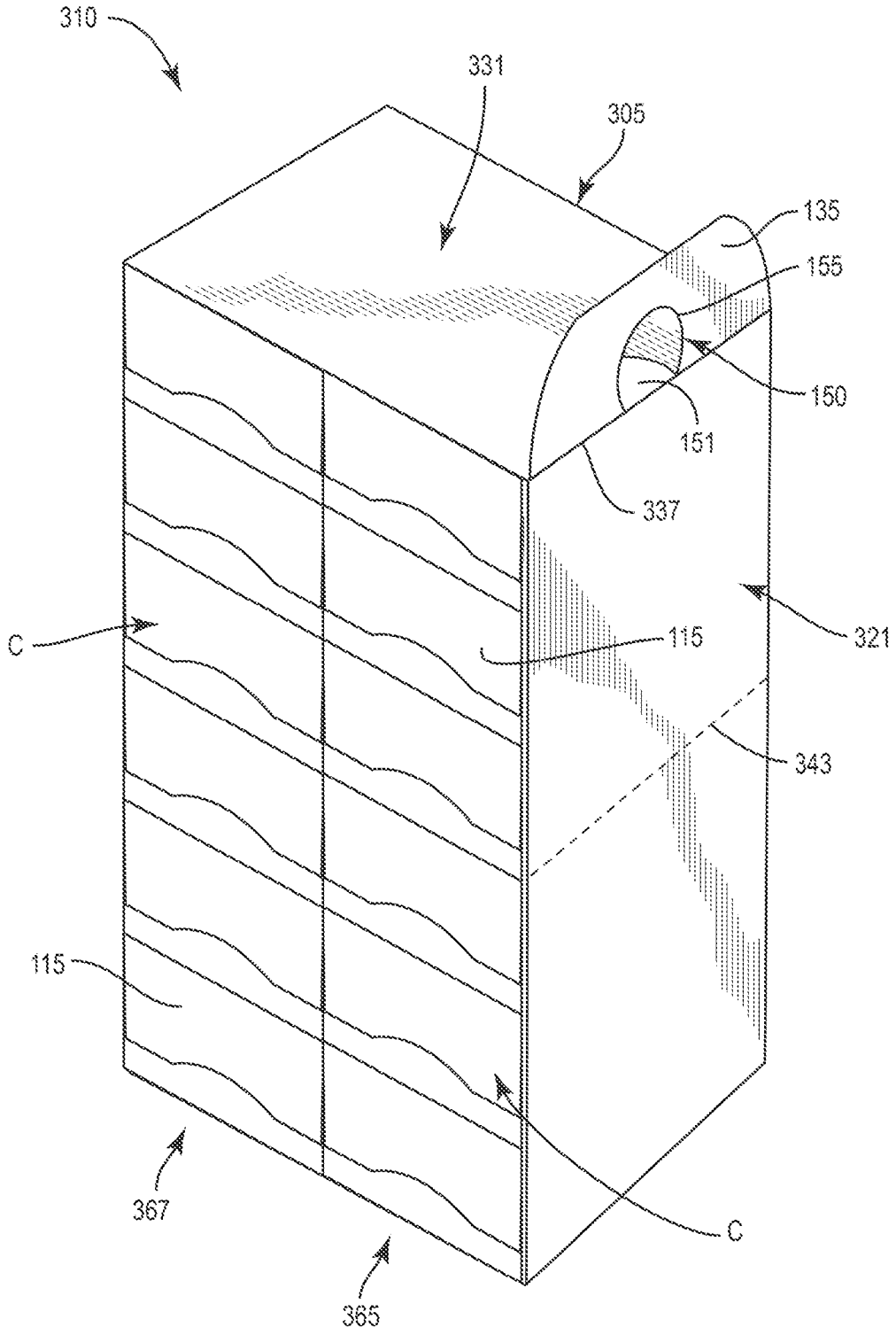

The package 310 can be formed similarly to the package 110 of the first embodiment, wherein the containers C (e.g., twelve containers or any suitable number of containers) are attached to the blank 303. For example, the side panels 113 of six of the containers C can be attached to the first side panel 321 and another six of the containers C can be attached to the second side panel 327 (e.g., by the releasable glue G). In an exemplary embodiment, the container C are considered to be arranged in two columns 365, 367 (FIGS. 9 and 10). As shown in FIGS. 9 and 10, the blank 303 can be folded along the fold lines 325, 329, 333 to position the containers C in a 2×6 arrangement (or any suitable arrangement) and to position the bottom panel 323 in face-to-face contact with the main panels 111 of the bottom-most containers C and the top panel 331 in face-to-face contact with the main panels 111 of the top-most containers C. Accordingly, the containers C can be attached to each of the panels 321, 323, 327, 331 with the releasable glue G. In the illustrated embodiment, the attachment flaps 135, 139 can be attached to one another in face-to-face contact (e.g., with adhesive). As shown in FIG. 9, one or more supplementary panels 360 can be attached to the ends 115 of the containers C on either or both sides of the package 310. The supplementary panel 360 can be similar or identical to the supplementary panel 160 of the prior embodiment. Alternatively, the supplementary panel 360 could be omitted or could be otherwise shaped, arranged, configured, and/or positioned without departing from the disclosure. The package 310 and/or the construct 305 could be otherwise formed without departing from the disclosure. For example, the containers C can be arranged in the 2×6 or other suitable arrangement and the blank 303 could be wrapped around the arrangement to form the construct 305 and the package 310.

In the illustrated embodiment, the containers C can be dispensed from the package 310 similarly to the first embodiment. For example, the construct 305 can be torn along the tear lines 343 and/or the fold lines 325, 329, 333, 337, 341 to separate the package 310 into segments. For example, one of the segments can include a lower section of the first side panel 321 foldably connected to a section of the bottom panel 323 along the fold line 325, these sections being attached to a grouping of three of the containers C, another one of the segments can include a lower section of the second side panel 327 foldably connected to a section of the bottom panel 323 along the fold line 329, these sections being attached to a grouping of three of the containers C, and another one of the segments can include the top panel 331 connected to an upper section of the second side panel 327 along the fold line 333 and to an upper section of the first side panel 321 via the attachment flaps 135, 139, these sections and the top panel 331 being attached to a grouping of six of the containers C. The package 310 could be further broken down or could be otherwise formed into segments. The containers C can be pulled off of the remainders of the construct 305 by pulling against the releasable glue G, for example. The containers C could be otherwise dispensed from the package 301 without departing from the disclosure.

In one embodiment, shipping and dispensing constructs of the disclosure can include an economic board wrap for boxed, rectangular product, or other products generally provided (e.g., sold) as a multipack unit that can break down into smaller units for ease of use, storage, and/or trash reduction. The built-in handle can facilitate easy portability and transportation of the packages in exemplary embodiments. In some embodiments, the wraps or constructs can replace plastic wrap material generally used to sell multipack units and can offer an economical, recyclable packaging solution to sell multipack units of soap, boxed snack food items, juice boxes, boxed candy, etc. In an exemplary embodiment, the supplementary panels can facilitate changes in branding, labeling, etc., and in some configurations, the packages can provide space for promotional items. In some embodiments, the present disclosure can relate to a plastic replacement for bulk wrapped items with a unique look that is ecofriendly and totally recyclable or at least partially recyclable and that can be designed to run on high speed machinery, which can help the constructs to be more cost effective in an exemplary embodiment.

Any of the features of the various embodiments of the disclosure can be combined with replaced by, or otherwise configured with other features of other embodiments of the disclosure without departing from the scope of this disclosure. The carrier styles and panel configurations described above are included by way of example.

In general, the blank may be constructed from paperboard having a caliper so that it is heavier and more rigid than ordinary paper. The blank can also be constructed of other materials, such as cardboard, or any other material having properties suitable for enabling the carrier to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A package comprising:

a shipping and dispensing construct comprising a plurality of panels and dispenser features extending in one or more panels of the plurality of panels;

a plurality of product holding containers that are removably adhered to one or more panels of the plurality of panels, wherein each panel of the plurality of panels is removably adhered to one or more of the product holding containers of the plurality of product holding containers;

wherein the dispenser features are for forming the package into a plurality of segments, and each segment of the plurality of segments is for comprising a portion of the shipping and dispensing construct and at least one of the product holding containers of the plurality of product holding containers.

2. The package of claim 1, wherein each of the panels of the plurality of panels is removably attached to a respective grouping of the product holding containers of the plurality of product holding containers.

3. The package of claim 2, wherein each of the panels of the plurality of panels comprises a first section that is removably attached to the respective grouping of the product holding containers and a second section that is removably attached to at least one of the product holding containers in another one of the groupings of the product holding containers.

4. The package of claim 3, wherein the dispenser features comprise a plurality of tear lines, each tear line of the plurality of tear lines extends in a respective one of the panels of the plurality of panels, for each panel of the plurality of panels, the first section is separable from the second section along the respective tear line, and each segment of the plurality of segments is for comprising the first section of one of the panels and the second section of another one of the panels both removably attached to the respective grouping of the product holding containers.

5. The package of claim 1, wherein the dispenser features comprise a tear line extending in each of the panels of the plurality of panels, and each of the panels of the plurality of panels comprises a first section separable from a second section along the respective tear line.

6. The package of claim 5, wherein, for each of the panels of the plurality of panels, the first section is removably attached to side panels of the product holding containers in a respective grouping of the product holding containers and the second section is removably attached to a main panel of one of the product holding containers in another grouping of the product holding containers.

7. The package of claim 1, wherein the dispenser features comprise a tear line extending laterally at least partially across at least one of the panels.

8. The package of claim 1, wherein the plurality of panels comprises at least a first panel, a second panel foldably connected to the first panel along a first lateral fold line, a third panel foldably connected to the second panel along a second lateral fold line, and a fourth panel foldably connected to the third panel along a third lateral fold line, and the dispenser features comprise a tear line extending laterally at least partially across each of at least the first panel, the second panel, and the third panel.

9. The package of claim 8, wherein the product holding containers are arranged in a first column and a second column, each of the product holding containers comprises a side panel, the first panel is removably attached to the side panels of the product holding containers in the first column, and the third panel is removably attached to the side panels of the product holding containers in the second column.

10. The package of claim 9, wherein each of the product holding containers comprises a main panel, the second panel is removably attached to the main panels of at least two of the product holding containers, and the fourth panel is removably attached to the main panels of at least two of the product holding containers.

11. The package of claim 1, wherein the plurality of panels comprises at least a first panel and a second panel, the shipping and dispensing construct further comprises a first attachment flap foldably connected to the first panel and a second attachment flap foldably connected to the second panel, and the first attachment flap is at least partially secured to the second attachment flap.

12. The package of claim 11, further comprising a handle comprising a handle opening in at least the second attachment flap.

13. The package of claim 12, wherein the handle further comprises a handle flap that is separable from the first attachment flap along a line of weakening, the handle flap is attached to one of the first panel and the second panel, and the first attachment flap and the second attachment flap are for being folded with respect to the handle panel to activate the handle.

14. The package of claim 1, wherein the plurality of panels comprises at least a first panel, a second panel foldably connected to the first panel along a first fold line, a third panel foldably connected to the second panel along a second fold line, and a fourth panel foldably connected to the third panel along a third fold line, wherein the first panel and the third panel are opposite one another and the second panel and the fourth panel are opposite one another, and wherein the shipping and dispensing construct further comprises a first attachment flap foldably connected to the first panel and a second attachment flap foldably connected to the fourth panel, and the first attachment flap and the second attachment flap are at least partially attached in face-to-face contact with one another.

15. The package of claim 1, further comprising a supplementary panel spaced apart from the plurality of panels and removably attached to at least one of the product holding containers.

16. The package of claim 1, wherein the product holding containers extend around a central opening of the package, and the package further comprises an inner sleeve extending in the central opening.

17. The package of claim 1, wherein the product holding containers are removably attached to the panels by a fugitive glue.

18. A shipping and dispensing construct for engaging a plurality of product holding containers, the shipping and dispensing construct comprising:

a plurality of panels, wherein the product holding containers are for being removably adhered to one or more panels of the plurality of panels, and wherein each panel of the plurality of panels is for being removably adhered to one or more of the product holding containers of the plurality of product holding containers; and dispenser features for forming the shipping and dispensing construct into a plurality of segments, the dispenser features extending in one or more panels of the plurality of panels, and each segment of the plurality of segments is for comprising at least one of the product holding containers of the plurality of product holding containers that is removably attached to a portion of at least one of the panels of the plurality of panels.

19. The shipping and dispensing construct of claim 18, wherein each of the panels of the plurality of panels comprises a first section for being removably attached to a respective grouping of the product holding containers of the plurality of product holding containers and a second section for being removably attached to at least one of the product holding containers in another one of the groupings of the product holding containers.

20. The shipping and dispensing construct of claim 19, wherein the dispenser features comprise a plurality of tear lines, each tear line of the plurality of tear lines extends in a respective one of the panels of the plurality of panels, for each panel of the plurality of panels, the first section is separable from the second section along the respective tear line, and each segment of the plurality of segments is for comprising the first section of one of the panels and the second section of another one of the panels.

21. The shipping and dispensing construct of claim 18, wherein the dispenser features comprise a tear line extending in each of the panels of the plurality of panels, and each of the panels of the plurality of panels comprises a first section separable from a second section along the respective tear line.

22. The shipping and dispensing construct of claim 18, wherein the dispenser features comprise a tear line extending laterally at least partially across at least one of the panels.

23. The shipping and dispensing construct of claim 18, wherein the plurality of panels comprises at least a first panel foldably connected to the first panel along a first lateral fold line, a second panel foldably connected to the second panel along a second lateral fold line, a third panel foldably connected to the third panel along a third lateral fold line, and a fourth panel, and the dispenser features comprise a tear line extending laterally at least partially across each of at least the first panel, the second panel, and the third panel.

24. The shipping and dispensing construct of claim 23, wherein the product holding containers are for being arranged in a first column and a second column, the first panel is for being removably attached to respective side panels of the product holding containers in the first column, the third panel is for being removably attached to respective side panels of the product holding containers in the second column, the second panel is for being removably attached to respective main panels of at least two of the product holding containers, and the fourth panel is for being removably attached to respective main panels of at least two of the product holding containers.

25. The shipping and dispensing construct of claim 18, wherein the plurality of panels comprises at least a first panel and a second panel, the shipping and dispensing construct further comprises a first attachment flap foldably connected to the first panel and a second attachment flap foldably connected to the second panel, and the first attachment flap is at least partially secured to the second attachment flap.

26. The shipping and dispensing construct of claim 25, further comprising a handle comprising a handle opening in at least the second attachment flap.

27. The shipping and dispensing construct of claim 26, wherein the handle further comprises a handle flap that is separable from the first attachment flap along a line of weakening, the handle flap is attached to one of the first panel and the second panel, and the first attachment flap and the second attachment flap are for being folded with respect to the handle panel to activate the handle.

28. The shipping and dispensing construct of claim 18, wherein the plurality of panels comprises at least a first panel, a second panel foldably connected to the first panel along a first fold line, a third panel foldably connected to the second panel along a second fold line, and a fourth panel foldably connected to the third panel along a third fold line, wherein the first panel and the third panel are opposite one another and the second panel and the fourth panel are opposite one another, and wherein the shipping and dispensing construct further comprises a first attachment flap foldably connected to the first panel and a second attachment flap foldably connected to the fourth panel, and the first attachment flap and the second attachment flap are at least partially attached in face-to-face contact with one another.

29. The shipping and dispensing construct of claim 18, wherein a supplementary panel is spaced apart from the plurality of panels, and the supplementary panel is for being removably attached to at least one of the product holding containers.

30. The shipping and dispensing construct of claim 18, wherein the product holding containers are for being arranged to extend around a central opening, and an inner sleeve is for being positioned to extend in the central opening.

31. A construct blank for forming a shipping and dispensing construct for engaging a plurality of product holding containers, the construct blank comprising:

a plurality of panels, wherein the product holding containers are for being removably adhered to one or more panels of the plurality of panels, and wherein each panel of the plurality of panels is for being removably adhered to one or more of the product holding containers of the plurality of product holding containers when the shipping and dispensing construct is formed from the construct blank; and dispenser features for forming the shipping and dispensing construct formed from the construct blank into a plurality of segments, the dispenser features extending in one or more panels of the plurality of panels, and each segment of the plurality of segments is for comprising at least one of the product holding containers of the plurality of product holding containers that is removably attached to a portion of at least one of the panels of the plurality of panels.

32. The construct blank of claim 31, wherein each of the panels of the plurality of panels comprises a first section for being removably attached to a respective grouping of the product holding containers of the plurality of product holding containers when the shipping and dispensing construct is formed from the construct blank and a second section for being removably attached to at least one of the product holding containers in another one of the groupings of the product holding containers when the shipping and dispensing construct is formed from the construct blank.

33. The construct blank of claim 31, wherein the dispenser features comprise a tear line extending in each of the panels of the plurality of panels, and each of the panels of the plurality of panels comprises a first section separable from a second section along the respective tear line.

34. The construct blank of claim 31, wherein the dispenser features comprise a tear line extending laterally at least partially across at least one of the panels.

35. The construct blank of claim 31, wherein the plurality of panels comprises at least a first panel, a second panel foldably connected to the first panel along a first lateral fold line, a third panel foldably connected to the second panel along a second lateral fold line, and a fourth panel foldably connected to the third panel along a third lateral fold line, and the dispenser features comprise a tear line extending laterally at least partially across each of at least the first panel, the second panel, and the third panel.

36. The construct blank of claim 35, wherein the first panel is for being removably attached to respective side panels of the product holding containers in a first column when the shipping and dispensing construct is formed from the construct blank, the third panel is for being removably attached to respective side panels of the product holding containers in a second column when the shipping and dispensing construct is formed from the construct blank, the second panel is for being removably attached to respective main panels of at least two of the product holding containers when the shipping and dispensing construct is formed from the construct blank, and the fourth panel is for being removably attached to respective main panels of at least two of the product holding containers when the shipping and dispensing construct is formed from the construct blank.

37. The construct blank of claim 31, wherein the plurality of panels comprises at least a first panel and a second panel, the construct blank further comprises a first attachment flap foldably connected to the first panel and a second attachment flap foldably connected to the second panel, and the first attachment flap is for being at least partially secured to the second attachment flap.

38. The construct blank of claim 37, further comprising a handle comprising a handle opening in at least the second attachment flap.

39. The construct blank of claim 38, wherein the handle further comprises a handle flap that is separable from the first attachment flap along a line of weakening, the handle flap is foldably connected to the first panel along a fold line.

40. The construct blank of claim 31, wherein the plurality of panels comprises at least a first panel, a second panel foldably connected to the first panel along a first fold line, a third panel foldably connected to the second panel along a second fold line, and a fourth panel foldably connected to the third panel along a third fold line, wherein the first panel and the third panel are for being opposite to one another when the shipping and dispensing construct is formed from the construct blank and the second panel and the fourth panel are opposite one another when the shipping and dispensing construct is formed from the construct blank, and wherein the construct blank further comprises a first attachment flap foldably connected to the first panel and a second attachment flap foldably connected to the fourth panel, and the first attachment flap and the second attachment flap are for being at least partially attached in face-to-face contact with one another.

41. The construct blank of claim 31 in combination with a supplementary panel for being removably attached to at least one of the product holding containers so that the supplementary panel is spaced apart from the plurality of panels.

42. The construct blank of claim 31 in combination with an insert blank, wherein the insert blank is for forming an inner sleeve that is for being positioned to extend in a central opening at least partially defined by the product holding containers.

43. A method comprising:

obtaining a construct blank comprising a plurality of panels and dispenser features extending in one or more panels of the plurality of panels;

removably adhering a plurality of product holding containers to one or more panels of the plurality of panels, wherein the removably adhering the plurality of product holding containers to one or more panels of the plurality of panels comprises removably adhering each panel of the plurality of panels to one or more of the product holding containers of the plurality of product holding containers; and forming the construct blank into a shipping and dispensing construct so that the shipping and dispensing construct and the plurality of product holding containers form a package;

wherein the dispenser features are for forming the package into a plurality of segments, and each segment of the plurality of segments is for comprising a portion of the shipping and dispensing construct and at least one of the product holding containers of the plurality of product holding containers.

44. The method of claim 43, wherein each of the panels of the plurality of panels comprises a first section and a second section, and the removably attaching the plurality of product holding containers to one or more panels of the plurality of panels comprises removably attaching the first section of each of the panels to a respective grouping of the product holding containers and removably attaching the second section of each of the panels to at least one of the product holding containers in another one of the groupings of the product holding containers.

45. The method of claim 44, wherein the dispenser features comprise a plurality of tear lines, each tear line of the plurality of tear lines extends in a respective one of the panels of the plurality of panels, for each panel of the plurality of panels, the first section is separable from the second section along the respective tear line, and each segment of the plurality of segments is for comprising the first section of one of the panels and the second section of another one of the panels both removably attached to the respective grouping of the product holding containers.

46. The method of claim 43, wherein the plurality of panels comprises at least a first panel , a second panel foldably connected to the first panel along a first lateral fold line, a third panel foldably connected to the second panel along a second lateral fold line, and a fourth panel foldably connected to the third panel along a third lateral fold line, and the dispenser features comprise a tear line extending laterally at least partially across each of at least the first panel, the second panel, and the third panel, each of the product holding containers comprises a side panel, the method further comprises arranging the product holding containers in a first column and a second column, and the removably attaching the plurality of product holding containers to one or more panels of the plurality of panels comprises removably attaching the first panel to respective side panels of the product holding containers in the first column and removably attaching the third panel to respective side panels of the product holding containers in the second column.

47. The method of claim 46, wherein each of the product holding containers comprises a main panel, and the removably attaching the plurality of product holding containers to one or more panels of the plurality of panels comprises removably attaching the second panel to the main panels of at least two of the product holding containers and removably attaching the fourth panel to the main panels of at least two of the product holding containers.

48. The method of claim 43, wherein the plurality of panels comprises at least a first panel and a second panel, the construct blank further comprises a first attachment flap foldably connected to the first panel and a second attachment flap foldably connected to the second panel, and the forming the construct blank into a shipping and dispensing construct comprises at least partially securing the first attachment flap to the second attachment flap.

49. The method of claim 48, wherein the construct blank further comprises a handle opening in at least the second attachment flap and a handle flap that is separable from the first attachment flap along a line of weakening, the forming the construct blank into a shipping and dispensing construct further comprises attaching the handle flap to one of the first panel and the second panel, and the first attachment flap and the second attachment flap are for being folded with respect to the handle flap to activate the handle.

50. The method of claim 43, further comprising removably attaching a supplementary panel to at least one of the product holding containers so that the supplementary panel is spaced apart from the plurality of panels.

51. The method of claim 43, further comprising arranging the product holding containers to extend around a central opening, and positioning an inner sleeve to extend in the central opening.

52. A package comprising:

a shipping and dispensing construct comprising a plurality of panels and dispenser features extending in one or more panels of the plurality of panels;

a plurality of product holding containers that are removably adhered to one or more panels of the plurality of panels;

wherein the dispenser features are for forming the package into a plurality of segments, and each segment of the plurality of segments is for comprising a portion of the shipping and dispensing construct and at least one of the product holding containers of the plurality of product holding containers; and wherein each of the panels of the plurality of panels is removably attached to a respective grouping of the product holding containers of the plurality of product holding containers.

53. A package comprising:

a shipping and dispensing construct comprising a plurality of panels and dispenser features extending in one or more panels of the plurality of panels;

a plurality of product holding containers that are removably adhered to one or more panels of the plurality of panels;

wherein the dispenser features are for forming the package into a plurality of segments, and each segment of the plurality of segments is for comprising a portion of the shipping and dispensing construct and at least one of the product holding containers of the plurality of product holding containers; and wherein the plurality of panels comprises at least a first panel and a second panel, the shipping and dispensing construct further comprises a first attachment flap foldably connected to the first panel and a second attachment flap foldably connected to the second panel, and the first attachment flap is at least partially secured to the second attachment flap.

54. A shipping and dispensing construct for engaging a plurality of product holding containers, the shipping and dispensing construct comprising:

a plurality of panels, wherein the product holding containers are for being removably adhered to one or more panels of the plurality of panels; and dispenser features for forming the shipping and dispensing construct into a plurality of segments, the dispenser features extending in one or more panels of the plurality of panels, and each segment of the plurality of segments is for comprising at least one of the product holding containers of the plurality of product holding containers that is removably attached to a portion of at least one of the panels of the plurality of panels;

wherein each of the panels of the plurality of panels comprises a first section for being removably attached to a respective grouping of the product holding containers of the plurality of product holding containers and a second section for being removably attached to at least one of the product holding containers in another one of the groupings of the product holding containers.

55. A shipping and dispensing construct for engaging a plurality of product holding containers, the shipping and dispensing construct comprising:

a plurality of panels, wherein the product holding containers are for being removably adhered to one or more panels of the plurality of panels; and dispenser features for forming the shipping and dispensing construct into a plurality of segments, the dispenser features extending in one or more panels of the plurality of panels, and each segment of the plurality of segments is for comprising at least one of the product holding containers of the plurality of product holding containers that is removably attached to a portion of at least one of the panels of the plurality of panels;

wherein the plurality of panels comprises at least a first panel and a second panel, the shipping and dispensing construct further comprises a first attachment flap foldably connected to the first panel and a second attachment flap foldably connected to the second panel, and the first attachment flap is at least partially secured to the second attachment flap.

56. A construct blank for forming a shipping and dispensing construct for engaging a plurality of product holding containers, the construct blank comprising:

a plurality of panels, wherein the product holding containers are for being removably adhered to one or more panels of the plurality of panels; and dispenser features for forming the shipping and dispensing construct formed from the construct blank into a plurality of segments, the dispenser features extending in one or more panels of the plurality of panels, and each segment of the plurality of segments is for comprising at least one of the product holding containers of the plurality of product holding containers that is removably attached to a portion of at least one of the panels of the plurality of panels;

wherein each of the panels of the plurality of panels comprises a first section for being removably attached to a respective grouping of the product holding containers of the plurality of product holding containers when the shipping and dispensing construct is formed from the construct blank and a second section for being removably attached to at least one of the product holding containers in another one of the groupings of the product holding containers when the shipping and dispensing construct is formed from the construct blank.

57. A construct blank for forming a shipping and dispensing construct for engaging a plurality of product holding containers, the construct blank comprising:

a plurality of panels, wherein the product holding containers are for being removably adhered to one or more panels of the plurality of panels; and dispenser features for forming the shipping and dispensing construct formed from the construct blank into a plurality of segments, the dispenser features extending in one or more panels of the plurality of panels, and each segment of the plurality of segments is for comprising at least one of the product holding containers of the plurality of product holding containers that is removably attached to a portion of at least one of the panels of the plurality of panels;

wherein the plurality of panels comprises at least a first panel and a second panel, the construct blank further comprises a first attachment flap foldably connected to the first panel and a second attachment flap foldably connected to the second panel, and the first attachment flap is for being at least partially secured to the second attachment flap.

58. A method comprising:

obtaining a construct blank comprising a plurality of panels and dispenser features extending in one or more panels of the plurality of panels;

removably adhering a plurality of product holding containers to one or more panels of the plurality of panels; and forming the construct blank into a shipping and dispensing construct so that the shipping and dispensing construct and the plurality of product holding containers form a package;

wherein the dispenser features are for forming the package into a plurality of segments, and each segment of the plurality of segments is for comprising a portion of the shipping and dispensing construct and at least one of the product holding containers of the plurality of product holding containers;

wherein each of the panels of the plurality of panels comprises a first section and a second section, and the removably attaching the plurality of product holding containers to one or more panels of the plurality of panels comprises removably attaching the first section of each of the panels to a respective grouping of the product holding containers and removably attaching the second section of each of the panels to at least one of the product holding containers in another one of the groupings of the product holding containers.

59. A method comprising:

obtaining a construct blank comprising a plurality of panels and dispenser features extending in one or more panels of the plurality of panels;

removably adhering a plurality of product holding containers to one or more panels of the plurality of panels; and forming the construct blank into a shipping and dispensing construct so that the shipping and dispensing construct and the plurality of product holding containers form a package;

wherein the dispenser features are for forming the package into a plurality of segments, and each segment of the plurality of segments is for comprising a portion of the shipping and dispensing construct and at least one of the product holding containers of the plurality of product holding containers;

wherein the plurality of panels comprises at least a first panel and a second panel, the construct blank further comprises a first attachment flap foldably connected to the first panel and a second attachment flap foldably connected to the second panel, and the forming the construct blank into a shipping and dispensing construct comprises at least partially securing the first attachment flap to the second attachment flap.

* * * * *